US011497277B2

(12) United States Patent
Mou et al.

(10) Patent No.: US 11,497,277 B2
(45) Date of Patent: Nov. 15, 2022

(54) DYNAMIC PRESSURE CONTROLLING FOOTWEAR

(71) Applicant: Microjet Technology Co., Ltd., Hsinchu (TW)

(72) Inventors: Hao-Jan Mou, Hsinchu (TW); Ching-Sung Lin, Hsinchu (TW); Chih-Kai Chen, Hsinchu (TW); Chi-Feng Huang, Hsinchu (TW); Yung-Lung Han, Hsinchu (TW); Chang-Yen Tsai, Hsinchu (TW); Wei-Ming Lee, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 13 days.

(21) Appl. No.: 17/314,377

(22) Filed: May 7, 2021

(65) Prior Publication Data

US 2021/0361031 A1 Nov. 25, 2021

(30) Foreign Application Priority Data

May 19, 2020 (TW) ..... 109116603

(51) Int. Cl.
*A43B 23/00* (2006.01)
*A43B 23/02* (2006.01)
(Continued)

(52) U.S. Cl.
CPC ..... *A43B 23/029* (2013.01); *A43B 3/26* (2013.01); *A43B 3/34* (2022.01); *A43B 3/38* (2022.01); *A43B 3/44* (2022.01)

(58) Field of Classification Search
CPC ..... A43B 23/028; A43B 23/029; A43B 3/44; A43B 3/34
(Continued)

(56) References Cited

U.S. PATENT DOCUMENTS 5,383,290 A * 1/1995 Grim ..... A43B 13/206 36/88
5,813,142 A * 9/1998 Demon ..... A43B 13/203 600/592
(Continued)

FOREIGN PATENT DOCUMENTS

CN 105852320 B 8/2018
CN 210329522 U 4/2020
WO WO 2009/152456 A2 12/2009

*Primary Examiner* — Marie D Bays
(74) *Attorney, Agent, or Firm* — Birch, Stewart, Kolasch & Birch, LLP

(57) ABSTRACT

A dynamic pressure controlling footwear is disclosed and includes a main body, a control box and plural dynamic pressure controlling components. The main body includes a vamp disposed on an airbag. The control box includes a microprocessor and is disposed on a top surface region of the vamp. Each dynamic pressure controlling component is positioned on the airbag and includes an actuating pump and a pressure sensor packaged on a substrate by a semiconductor process. The substrate is positioned on the airbag and electrically connected to the microprocessor of the control box through a conductor. The actuating pump is in fluid communication with the airbag for inflating the airbag. The pressure sensor detects an inner pressure of the airbag to generate a pressure information. The microprocessor enables or disables the actuating pump according to the pressure information, so that the inner pressure of the airbag is adjusted.

7 Claims, 10 Drawing Sheets

(51) Int. Cl.

| | |
|---|---|
| ***A43B 3/26*** | (2006.01) |
| ***A43B 3/38*** | (2022.01) |
| ***A43B 3/34*** | (2022.01) |
| ***A43B 3/44*** | (2022.01) |

(58) Field of Classification Search
USPC ..... 36/45, 88
See application file for complete search history.

(56) References Cited

U.S. PATENT DOCUMENTS

| | | | | |
|---|---|---|---|---|
| 6,305,102 | B1 * | 10/2001 | Doyle | A43B 13/206 36/71 |
| 7,513,067 | B2 * | 4/2009 | Marvin | A43B 23/0255 36/88 |
| 2004/0003517 | A1 * | 1/2004 | Marvin | A43B 13/20 36/29 |
| 2017/0348181 | A1 * | 12/2017 | Perriard | A43B 13/203 |
| 2019/0000186 | A1 * | 1/2019 | Mou | A43B 23/029 |
| 2019/0053572 | A1 * | 2/2019 | Patton | A43B 13/203 |
| 2021/0120915 | A1 * | 4/2021 | Panian | A43B 23/029 |
| 2021/0244128 | A1 * | 8/2021 | Costa | A43B 3/0036 |

* cited by examiner

DYNAMIC PRESSURE CONTROLLING FOOTWEAR

FIELD OF THE INVENTION

The present disclosure relates to a dynamic pressure controlling footwear, and more particularly to a dynamic pressure controlling footwear having an air pressure controlling component combined with a main body of the footwear.

BACKGROUND OF THE INVENTION

Generally, shoelaces are used in most conventional footwear as a means of loosening, tying and fixing the shoes on the feet. However, the footwear with shoelaces has many problems of inconvenience when putting on it. For example, when the shoelaces are loosened while moving, they have to be retied and resulted in inconvenience and waste of time. Furthermore, footwear with shoelaces may also bring potential risk. For example, when the shoelaces are accidentally loosened, it might be stepped by other people and makes wearer trip over it, or the shoelaces may be rolled in the gap of an escalator, a bicycle chain or a motorcycle pin etc., which may cause undesired accidents. In addition, wearing the footwear with shoelaces in a long time may put excessive pressure on the feet and cause discomfort. In addition, a small number of conventional footwear uses other means for loosening the footwear from the foot and fixing the footwear to the foot. For example, devil felt or sock-style shoe bodies can be used. However, the fixing performance of the devil felt is insufficient and easy to fall off, and the stickiness of the devil felt is reduced in long-term use. It causes inconvenience in activities, and is not suitable for sports. The fixing performance of the sock-type shoe bodies is also insufficient to fix the footwear to the foot, and the elasticity of the sock-type shoe bodies is not adjustable according to the requirements. In long-term use, the sock-type shoe bodies are easy to be loosen. Both of them cannot meet the needs of fixing the footwear to the foot. On the other hand, the conventional footwear can only be selected based on the corresponding size of the foot length, but this is not able to satisfy the needs of everyone's foot shape. When the width of the foot is too wide or too narrow relative to the shoe body worn, or the height of the shoe body is too high or too flat, it is easy to cause discomfort to the foot, and it is more likely to cause injury during activities.

Therefore, there is a need to provide a dynamic pressure controlling footwear capable of being adjusted to suit the shape of the wearer's foot, and comfortably covering and fixing the foot.

SUMMARY OF THE INVENTION

An object of the present disclosure is to provide a dynamic pressure controlling footwear. By inflating an airbag on a vamp to expand, the vamp is closely fit the user's foot, so as to allow the footwear to be adjusted to suit the shape of the wearer's foot, and comfortably cover and fix the foot. Moreover, it also provides the function of air pressure adjustment. The internal air pressure can be adjusted automatically according to the state of use, so as to achieve the most comfortable pressure for wearing shoes.

In accordance with an aspect of the present disclosure, a dynamic pressure controlling footwear is provided and includes a main body, a control box and a plurality of dynamic pressure controlling components. The main body includes a vamp and an airbag disposed on the vamp. The control box includes a microprocessor disposed on a top surface region of the vamp. The plurality of dynamic pressure controlling components are positioned on the airbag. Each of the plurality of dynamic pressure controlling components includes an actuating pump and a pressure sensor packaged on a substrate by a semiconductor process. The substrate is positioned on the airbag, and electrically connected to the microprocessor of the control box through a conductor. The actuating pump is in fluid communication with the airbag and receives a driving signal transmitted from the microprocessor to execute an actuating air-guiding operation, so that the airbag is inflated and expanded. The pressure sensor detects an inner pressure of the airbag to generate a pressure information and transmits to the microprocessor. The microprocessor controls the actuating pump to be enabled or disabled according to the pressure information, so that the inner pressure of the airbag can be adjusted.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
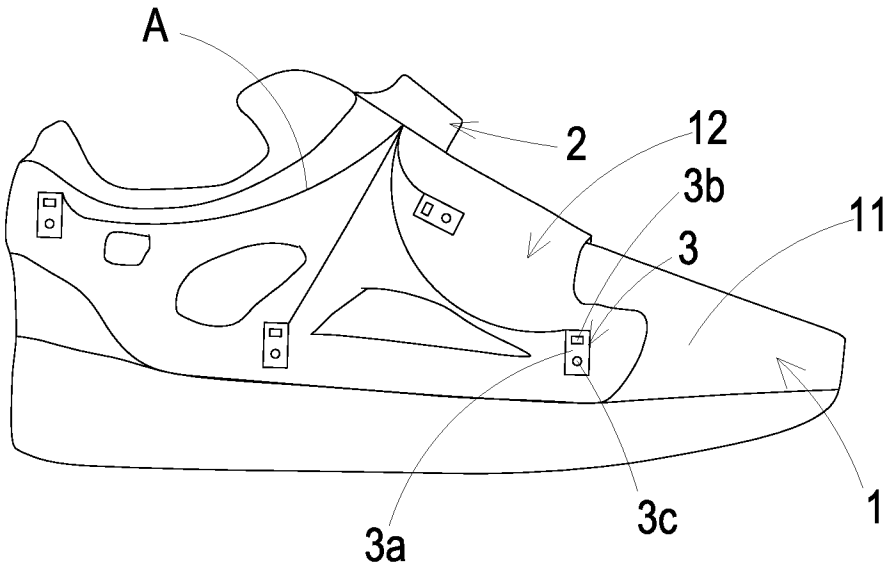
FIG. 1A is a lateral view illustrating a dynamic pressure controlling footwear according to an embodiment of the present disclosure.
Figure 1B:
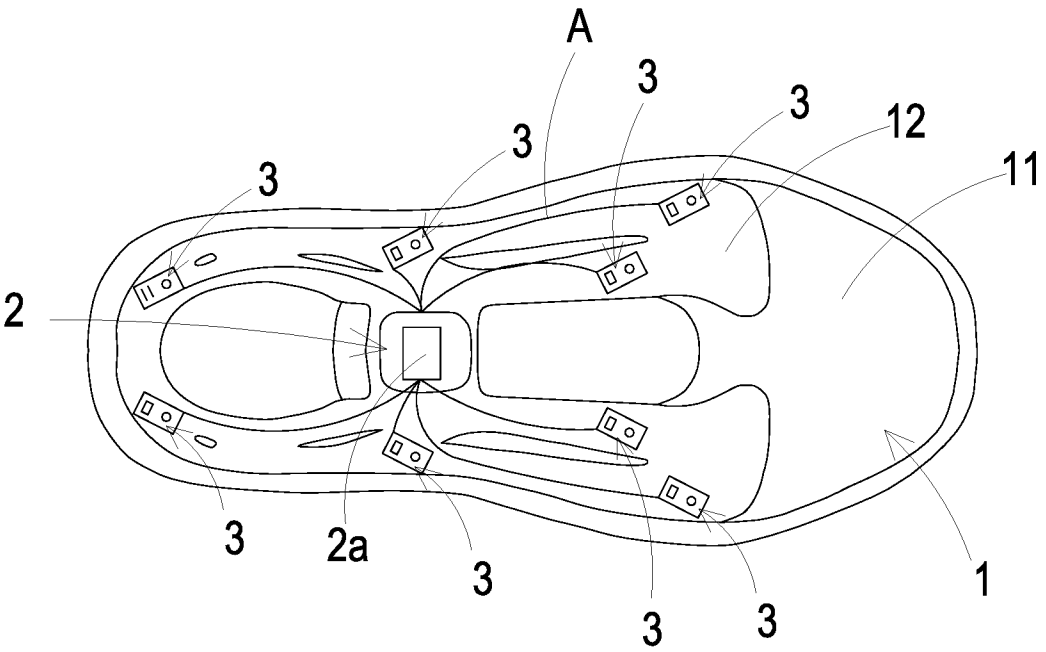
FIG. 1B is a top view illustrating the dynamic pressure controlling footwear according to the embodiment in FIG. 1A of the present disclosure.
Figure 2:
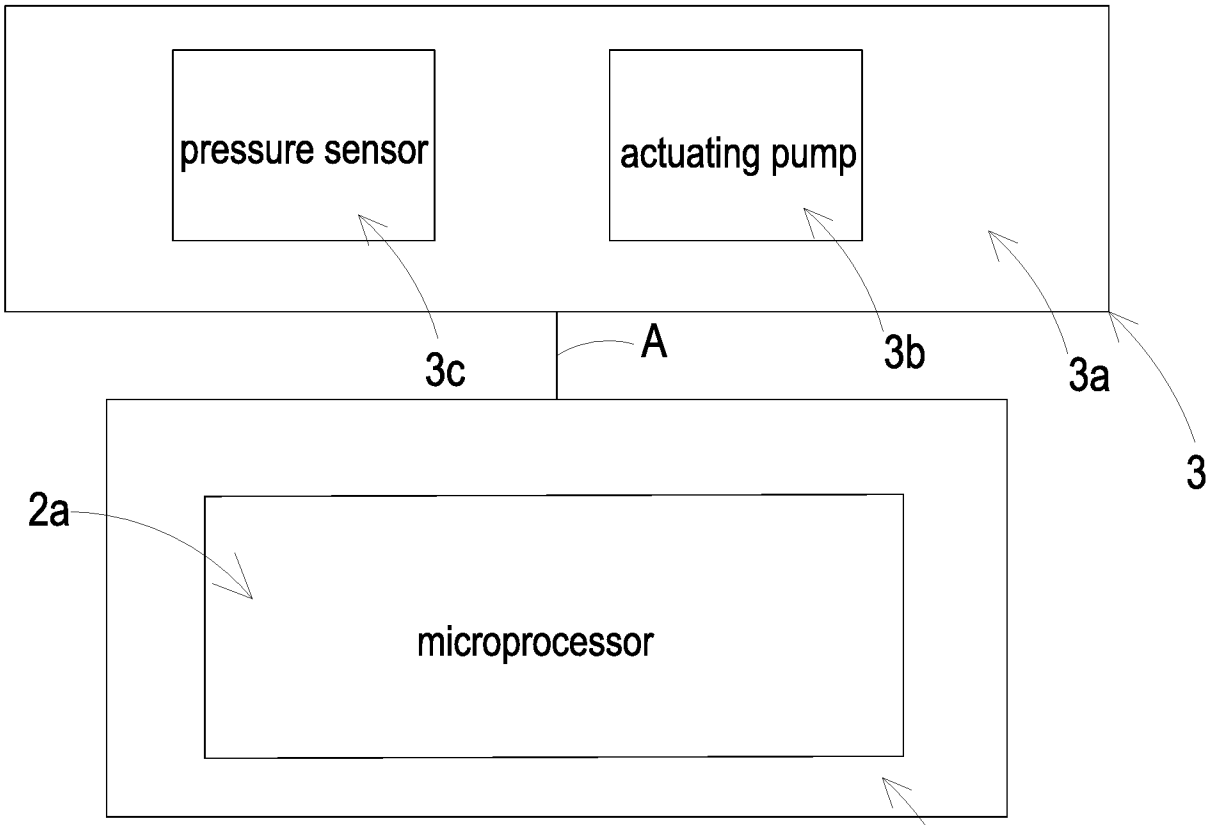
FIG. 2 is a block diagram of the dynamic pressure controlling footwear showing the connection of the control box and the dynamic pressure controlling component according to the embodiment of the present disclosure.
Figure 3A:
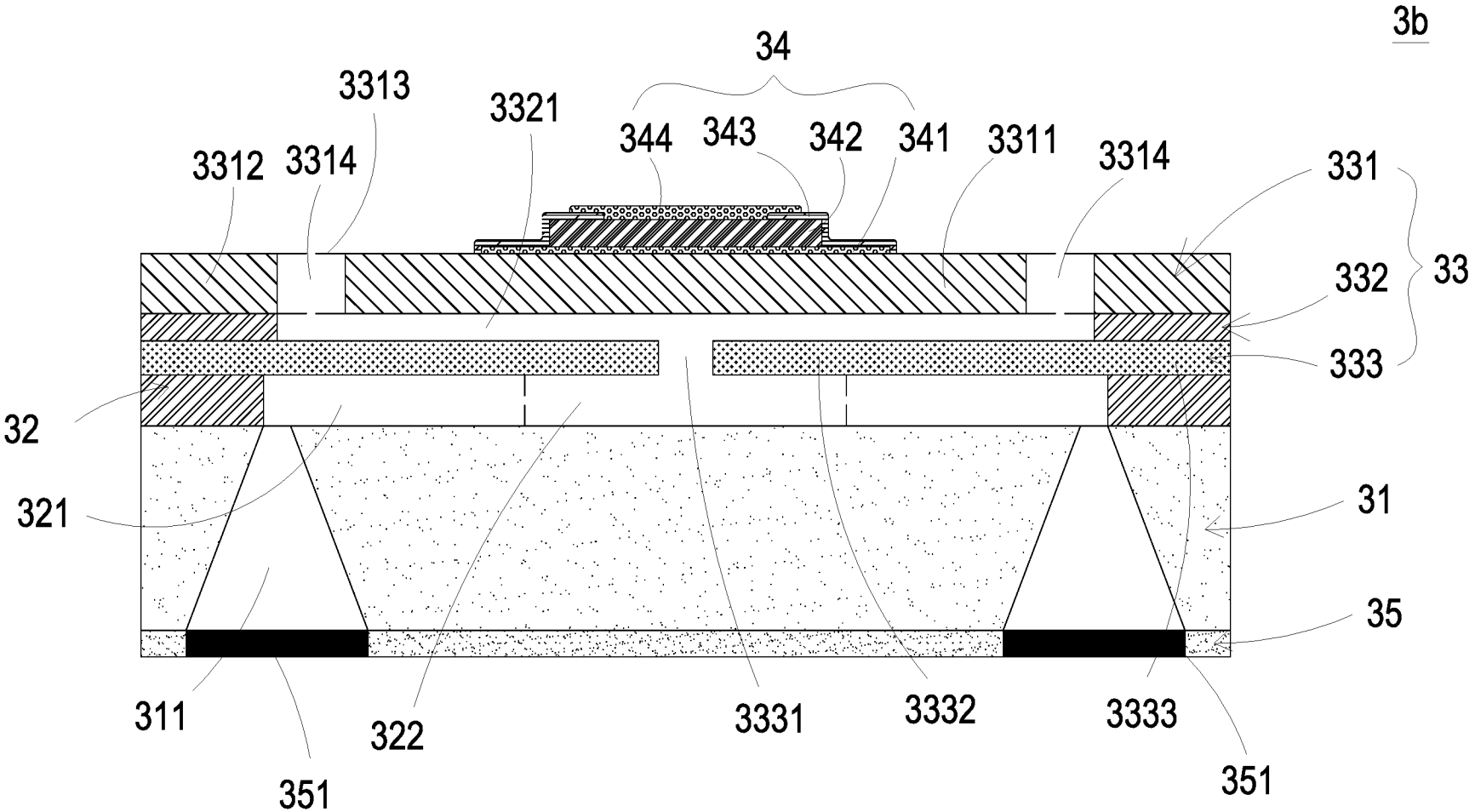
FIG. 3A is a schematic cross-sectional view illustrating the actuating pump of the dynamic pressure controlling component according to the embodiment of the present disclosure.
Figure 3B:
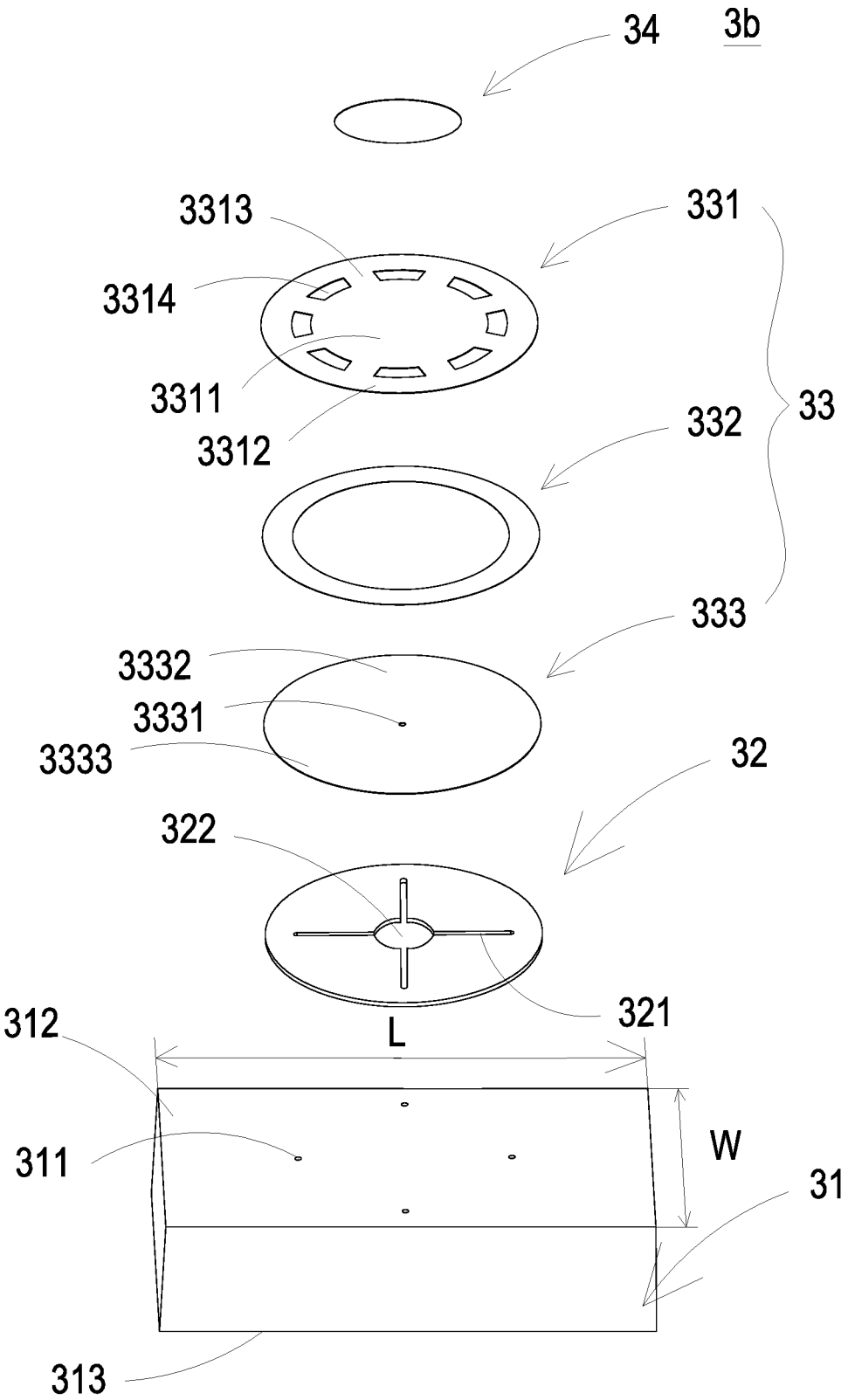
FIG. 3B is an exploded view illustrating the actuating pump of the dynamic pressure controlling component according to the embodiment of the present disclosure.

Please refer to FIGS. 1 and 2. The present disclosure provides a dynamic pressure controlling footwear, which includes a main body 1, a control box 2 and a plurality of dynamic pressure controlling components 3. In the embodiment, the main body 1 includes a vamp 11 and an airbag 12. The airbag 12 is disposed on the vamp 11 and covers the foot of the user wearing the footwear. The control box 2 includes a microprocessor 2*a*. The control box 2 is disposed on a top surface region of the vamp 11. The plurality of dynamic pressure controlling components 3 are woven and positioned on the airbag 12. Each dynamic pressure controlling component 3 includes an actuating pump 3*b* and a pressure sensor 3*c*, which are packed on a substrate 3*a* by a semiconductor process. The substrate 3*a* is woven and positioned on the airbag 12, and electrically connected to the microprocessor 2*a* of the control box 2 through a conductor A. The actuating pump 3*b* is in fluid communication with the airbag 12. When the actuating pump 3*b* receives a driving signal transmitted from the microprocessor 2*a*, the actuating pump 3*b* is enabled to execute an actuating air-guiding operation, so that air is introduced into the airbag 12, and the airbag 12 is inflated and expanded, so as to fix the foot of the user in the footwear, and achieve an effect similar to the shoelaces. In the embodiment, the pressure sensor 3*c* is configured to detect an inner pressure of the airbag 12 to generate a pressure information. The pressure sensor 3*c* transmits the pressure information to the microprocessor 2*a*. The microprocessor 2*a* controls the actuating pump 3*b* to be enabled or disabled according to the pressure information. In that, the actuating pumps 3*b* of the plurality of dynamic pressure controlling components 3 can inflate the airbag 12, and adjust the inner pressure of the airbag 12 according to the detections of the pressure sensors 3*c*. Thus, the footwear fits the status of use for the wearer's foot shape and can be worn under the most comfortable pressure. In the embodiment, the substrate 3*a* is a silicon substrate. As shown in FIG. 3B, the actuating pump 3*b* has a length ranging from 300 μm to 800 μm, and a width ranging from 300 μm to 800 μm. Preferably but not exclusively, the actuating pump 3*b* has a length ranging from 500 μm to 700 μm, and a width ranging from 500 μm to 700 μm.

How the above-mentioned actuating pump 3*b* executes the actuating air-guiding operation is described in detail as follows. In the embodiment, preferably but not exclusively, the actuating pump 3*b* is a microelectromechanical systems (MEMS) pump. Please refer to FIG. 3A and FIG. 3B. The actuating pump 3*b* includes a first substrate 31, a first oxidation layer 32, a second substrate 33, a piezoelectric component 34 and a valve layer 35. In the embodiment, the MEMS pump is integrally formed through the semiconductor manufacturing processes, such as epitaxy, deposition, lithography, and etching process. In order to describe the internal structure of the MEMS pump in detail, the exploded view thereof is shown in FIG. 3B to describe it in detail.

Preferably but not exclusively, the first substrate 31 is a Si wafer. The first substrate 31 includes a plurality of inlet apertures 311. In the embodiment, there are four inlet apertures 311, but not limited thereto. Each inlet aperture 311 penetrates through the first substrate 31. In order to improve the inlet-inflow effect, the plurality of inlet apertures 311 are provided in a tapered shape, and the pore size thereof is decreased gradually.

The first oxidation layer 32 is a silicon dioxide ($SiO_2$) thin film and stacked on a surface of the first substrate 31. The first oxidation layer 32 includes a plurality of convergence channels 321 and a convergence chamber 322. The numbers and the arrangements of the convergence channels 321 and the inlet apertures 311 of the first substrate 31 are corresponding to each other. In the embodiment, there are four convergence channels 321. First ends of the four convergence channels 321 are in fluid communication with the four inlet apertures 311 of the first substrate 31, and second ends of the four convergence channels 321 are in fluid communication with the convergence chamber 322. Thus, after the gas is inhaled through the inlet apertures 311, the gas flows through the corresponding convergence channels 321 and is converged into the convergence chamber 322.

Preferably but not exclusively, the second substrate 33 is a silicon on insulator (SOI) wafer, and includes a silicon wafer layer 331, a second oxidization layer 332 and a silicon material layer 333. The silicon wafer layer 331 includes an actuating portion 3311, an outer peripheral portion 3312, a plurality of connecting portions 3313 and a plurality of fluid channels 3314. The actuating portion 3311 is located at a central region of the silicon wafer layer 331. The outer peripheral portion 3312 is disposed around the actuating portion 3311. The plurality of connecting portions 3313 are connected between the actuating portion 3311 and the outer peripheral portion 3312, respectively, so as to connect the actuating portion 3311 and the outer peripheral portion 3312 for elastically supporting. The plurality of fluid channels 3314 are disposed around the actuating portion 3311, placed between the actuating portion 3311 and the outer peripheral portion 3312, and located between the connecting portions 3313, respectively.

The second oxidation layer 332 is a silicon monoxide (SiO) layer, formed on the silicon wafer layer 331 and in a hollow ring shape. A vibration chamber 3321 is collaboratively defined by the second oxidation layer 332 and the silicon wafer layer 331. The silicon material layer 333 is disposed on the second oxidation layer 332, and the second substrate 33 is bonded to the first oxide layer 32. The silicon material layer 333 is a silicon dioxide ($SiO_2$) thin film and includes a through hole 3331, a vibration portion 3332 and a fixing portion 3333. The through hole 3331 is formed at a center of the silicon material layer 333. The vibration portion 3332 is disposed around the through hole 3331 and vertically corresponds to the vibration chamber 3321. The fixing portion 3333 is located at a peripheral region of the silicon material layer 333. The fixing portion 3333 is formed on the second oxidation layer 332.

In the embodiment, the piezoelectric component 34 is formed and stacked on the actuating portion 3311 of the silicon wafer layer 331, and includes a lower electrode layer 341, a piezoelectric layer 342, an insulation layer 343 and an upper electrode layer 344. The lower electrode 341 is formed and stacked on the actuating portion 3311 of the silicon wafer layer 331. The piezoelectric layer 342 is formed and stacked on the lower electrode layer 341. The piezoelectric layer 342 and the lower electrode layer 341 are electrically connected through the contact area thereof. In addition, the width of the piezoelectric layer 342 is less than the width of the lower electrode layer 341, so that the lower electrode layer 341 is not completely covered by the piezoelectric layer 342. The insulation layer 343 is formed and stacked on a partial surface of the piezoelectric layer 342 and a partial surface of the lower electrode layer 341, which is not covered by the piezoelectric layer 342. The upper electrode layer 344 is formed and stacked on the insulation layer 343 and a remaining surface of the piezoelectric layer 342 without the insulation layer 343 disposed thereon, so that the upper electrode layer 344 is contacted and electrically connected with the piezoelectric layer 342. At the same time, the insulation layer 343 is used for insulation between the upper electrode layer 344 and the lower electrode layer 341, so as to avoid the short circuit caused by direct contact between the upper electrode layer 344 and the lower electrode layer 341.

Figure 5A:
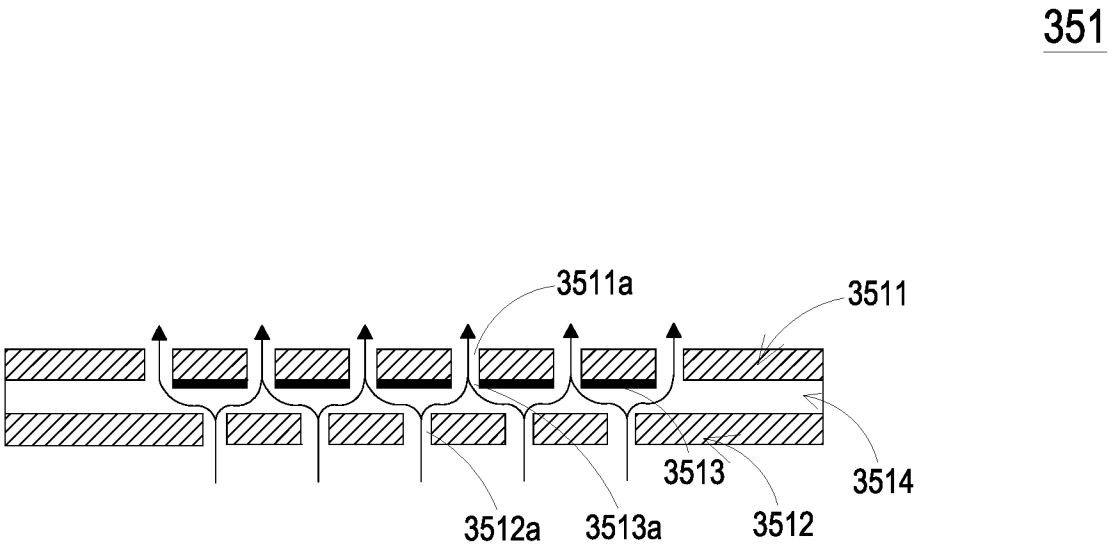
FIG. 5A is a schematic cross-sectional view illustrating valve unit of the valve layer of the actuating pump in open state according to the embodiment of the present disclosure.

In the embodiment, the valve layer 35 is formed and stacked on the first substrate 31. Moreover, a valve unit 351 respectively corresponding to the inlet aperture 311 is fabricated in a photolithographic etching process. Please refer to FIG. 2 and FIG. 5A. In the embodiment, the valve unit 351 includes a valve conductive layer 3511, a valve base layer 3512 and a flexible membrane 3513 made of, for example, graphene materials, but not limited to, so as to form a miniaturized structure. In the embodiment, the valve conductive layer 3511 is formed by an electrically charged piezoelectric material, and is electrically connected to the microprocessor 2*a* of the control box 2 through the conductor A. The microprocessor 2*a* receives a detection signal from the pressure sensor 3*c*, calculates the detection signal to obtain a driving signal, and outputs the driving signal to control the valve conductive layer 3511 to deform. In the embodiment, an accommodation space 3514 is maintained between the valve conductive layer 3511 and the valve base layer 3512. When the valve conductive layer 3511 does not receive the driving signal, the valve conductive layer 3511 is maintained in the accommodation space 3514 and form a distance from the valve base layer 3512. In the embodiment, the flexible membrane 3513 is made of a flexible material, attached to one side of the valve conductive layer 3511 and placed in the accommodation space 3514. In the embodiment, a plurality of through holes 3511*a*, 3512*a*, 3513*a* are formed on the valve conductive layer 3511, the valve base layer 3512 and the flexible membrane 3513, respectively, wherein the through hole 3511*a* of the valve conductive layer 3511 and the through hole 3513*a* of the flexible membrane 3513 are aligned to each other, and the through hole 3512*a* of the valve base layer 3512 and the through hole 3511*a* of the valve conductive layer 3511 are misaligned to each other. When the valve conductive layer 3511 does not receive the driving signal, the valve conductive layer 3511 is maintained in the accommodation space 3514 and form a distance from the valve base layer 3512, and the through hole 3512*a* of the valve base layer 3512 and the through hole 3511*a* of the valve conductive layer 3511 are misaligned to each other, so that the valve unit 351 is opened. At this time, the air outside the actuating pump 3*b* is inhaled into the accommodation space 3154 through the through hole 3512*a* of the valve base layer 3512. Moreover, since the through hole 3511*a* of the valve conductive layer 3511 and the through hole 3513*a* of the flexible membrane 3513 are aligned to each other, the air further flows through the through hole 3513*a* of the flexible film 3513 and the through hole 3511*a* of the valve conductive layer 3511 to enter the inflow apertures 311 of the first substrate 31, as shown in FIG. 3A.

Figure 5B:
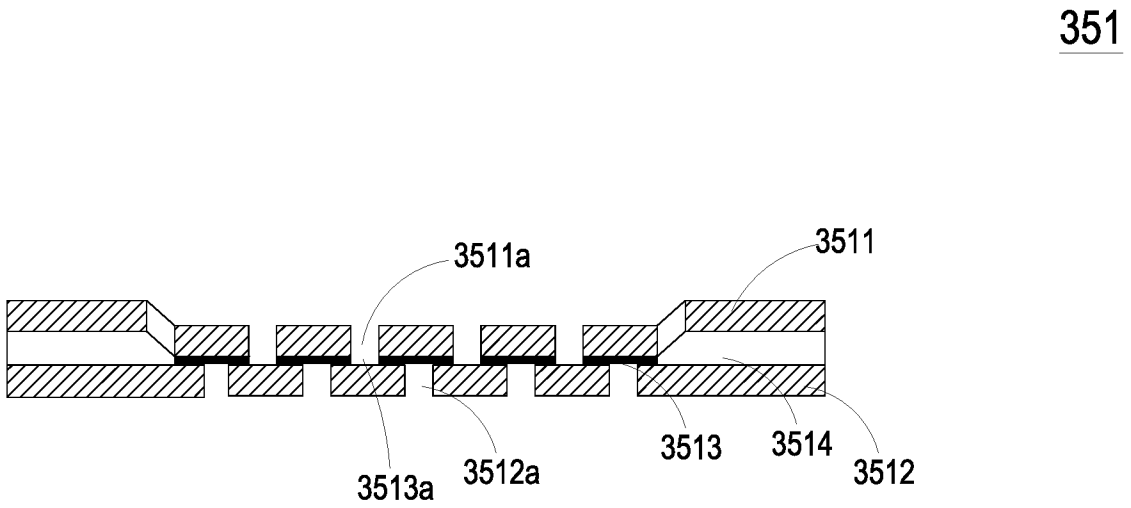
FIG. 5B is a schematic cross-sectional view illustrating valve unit of the valve layer of the actuating pump in close state according to the embodiment of the present disclosure.

Please refer to FIG. 5B. When the valve conductive layer 3511 receives the driving signal, the valve conductive layer 3511 is deformed, moved toward and attached to the valve base layer 3512, the through hole of the valve base 3512 is sealed by the flexible membrane 3513 because the through hole 3513*a* of the flexible membrane 351 and the through hole 3512*a* of the valve base 3512 are misaligned to each other, thereby the valve unit 351 is closed. At this time, the air outside the actuating pump 3*b* is blocked by the valve unit 351 and cannot enter the inlet apertures 311 of the first substrate 31.

Figure 4A:
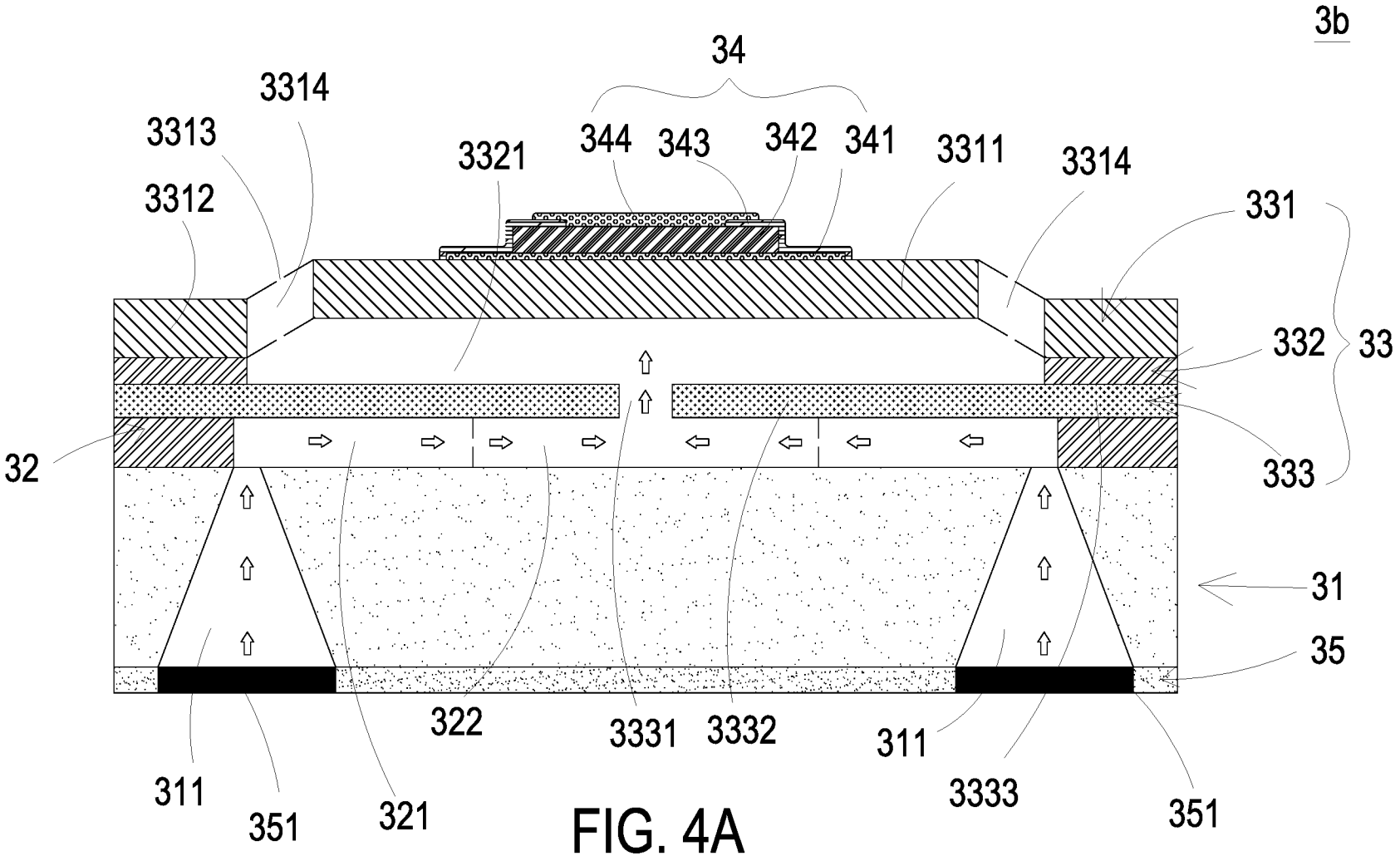
FIGS. 4A to 4C are schematic cross-sectional views illustrating actions of the actuating pump of the dynamic pressure controlling component according to the embodiment of the present disclosure.
Figure 4B:
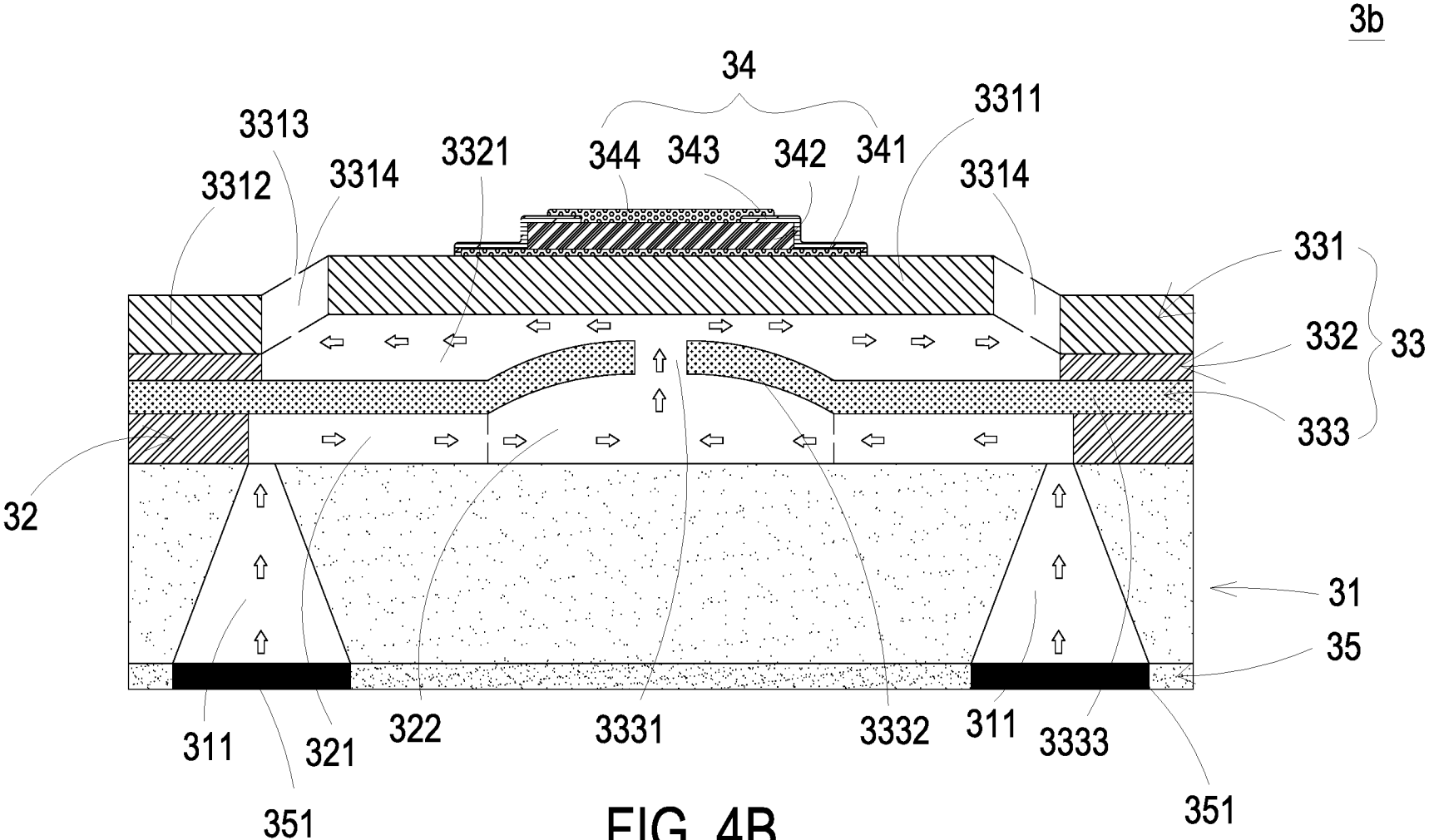
Figure 4C:
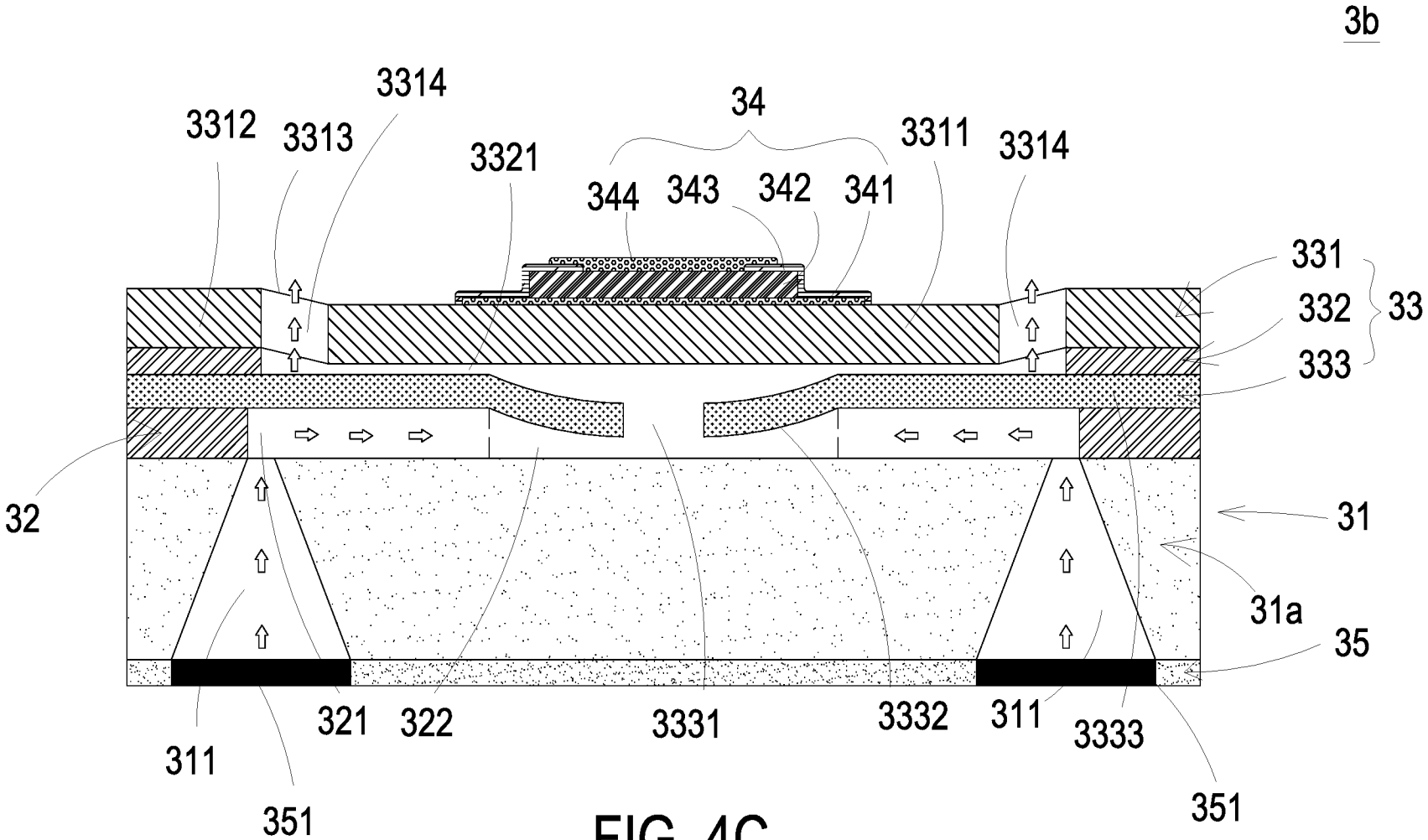

As for how the actuating pump 3*b* executes the actuating air-guiding operation, please refer to FIG. 4A. When the lower electrode layer 341 and the upper electrode layer 344 of the piezoelectric component 34 receive the driving signal (not shown) transmitted by the microprocessor 2*a* of the control box 2, and the microprocessor 2*a* controls the valve unit 351 to be opened, the piezoelectric plate 314 is deformed due to the piezoelectric effect, and the actuating portion 3311 of the silicon wafer layer 331 is driven to displace. The air outside the actuating pump 3*b* passes through the valve unit 351, flows into the inlet apertures 311, and further flows into the convergence chamber 322 of the first oxidation layer 32. When the piezoelectric component 34 drives the actuating portion 3311 to move upwardly to increase the distance between the actuating portion 3311 and the second oxide layer 332, the volume of the vibration chamber 3321 of the second oxidation layer 332 is increased, and a negative pressure is formed in the vibration chamber 3321, so that the air in the convergence chamber 322 is introduced into the vibration chamber 3321 through the through hole 3331. Please refer to FIG. 4B. When the actuating portion 3311 is driven by the piezoelectric component 34 to displace upwardly, the vibration portion 3332 of the silicon material layer 333 is moved upwardly in resonance. When the vibration portion 3332 is moved upwardly, the space of the vibration chamber 3321 is compressed, and the air in the vibration chamber 3321 is pushed to move to the fluid channels 3314 of the silicon wafer layer 331, so that the air is transported upwardly into the airbag 12 (referring to FIGS. 1A and 1B) through the fluid channels 3314. When the vibration portion 3332 is moved upwardly to compress the vibration chamber 3321, the volume of the convergence chamber 322 is increased due to the displacement of the vibration portion 3332, and a negative pressure is formed in the convergence chamber 322. In that, the air outside the actuating pump 3*b* is inhaled into the actuating pump 3*b* through the inlet apertures 311. Finally, as shown in FIG. 4C, when the piezoelectric component 34 drives the actuating portion 3311 of the silicon wafer layer 331 to move downwardly, the air in the vibration chamber 3321 is pushed to the fluid channels 3314 and further transported into the airbag 12 (referring to FIGS. 1A and 1B). Moreover, the vibration portion 3332 of the silicon material layer 333 is also driven by the actuating portion 3311 to move downwardly, and the air in the convergence chamber 322 is compressed synchronously to move to the vibration chamber 3321 through the through hole 3331. Thereafter, the piezoelectric component 34 drives the actuating portion 3311 to move upwardly, the volume of the vibration chamber 3321 is greatly increased, and the air is inhaled into the vibration chamber 3321 with a higher suction force. By repeating the above actions continuously, the piezoelectric component 34 drives the actuating portion 3311 to move upwardly and downwardly, and the vibration portion 3332 is driven synchronously to move upwardly and downwardly. Through changing the internal pressure of the actuating pump 3*b*, the external air is transported continuously into the airbag 12 (referring to FIGS. 1A and 1B). Thus, the actuating air-guiding operation of the actuating pump 3*b* is achieved.

From the above description, the actuating pump 3*b* receives the driving signal from the microprocessor 2*a* to execute actuating air-guiding operation to inflate and expand the airbag 12. The pressure sensor 3*c* detects the internal pressure of the airbag 12, and transmits the measured pressure information to the microprocessor 2*a*. Preferably but not exclusively, a plurality of pressure sensors 3*c* preset a threshold in advance. When the pressure sensor 3*c* detects that the inner pressure of the airbag 12 reaches an appropriate level for fitting the shape of the wearer's foot, the microprocessor 2*a* disables the actuating pump and closes the valve unit 351 to be at the same time. When one pressure sensor 3*c* of the actuating pump 3*b* of the dynamic pressure controlling component 3 disposed at some specific place detects that the inner pressure measured is greater than the preset threshold, the microprocessor 2*a* can control the valve unit 351 of the dynamic pressure controlling component 3 disposed at that place to be opened, so as to adjust the inner pressure of the airbag 12 at that place. In that, the plurality of the actuating pumps 3*b* of the dynamic pressure components 3 can inflate the airbag 12, and automatically adjust the inner pressure of the airbag 12 according to the information detected by the pressure sensors 3*c*. Thus, the footwear fits the status of use for the wearer's foot shape and can be worn under the most comfortable pressure.

In summary, the present disclosure provides a dynamic pressure controlling footwear. With a plurality of dynamic pressure controlling components disposed on the airbag part of the main body and connected to a microprocessor of a control box, the operations of the actuating pumps and the pressure sensors of the plurality of dynamic pressure controlling components are controlled by the microprocessor of the control box. Whereby, the airbag can be inflated by controlling the actuating pump, and the internal air pressure of the airbag can be automatically adjusted according to the detected information of the pressure sensors. Thus, the footwear fits the status of use of the wearer's foot shape and can be worn under the most comfortable pressure.

While the disclosure has been described in terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A dynamic pressure controlling footwear comprising:

a main body comprising a vamp and an airbag, wherein the airbag is disposed on the vamp;

a control box comprising a microprocessor, wherein the control box is disposed on a top surface region of the vamp; and a plurality of dynamic pressure controlling components positioned on the airbag, wherein each of the plurality of dynamic pressure controlling components comprises an actuating pump and a pressure sensor packaged on a substrate by a semiconductor process, wherein the substrate is positioned on the airbag and electrically connected to the microprocessor of the control box through a conductor, wherein the actuating pump is in fluid communication with the airbag and receives a driving signal transmitted from the microprocessor to execute an actuating air-guiding operation, so as to inflate and expand the airbag, wherein the pressure sensor detects an inner pressure of the airbag to generate a pressure information and transmits the pressure information to the microprocessor, wherein the microprocessor enables or disables the actuating pump according to the pressure information, so that the inner pressure of the airbag is adjusted.

2. The dynamic pressure controlling footwear according to claim 1, wherein the actuating pump is a microelectromechanical systems (MEMS) pump comprising:

a first substrate having a plurality of inlet apertures;

a first oxidation layer stacked on the first substrate, wherein the first oxidation layer comprises a plurality of convergence channels and a convergence chamber, and the plurality of convergence channels are in fluid communication between the convergence chamber and the plurality of inlet apertures;

a second substrate positioned on and combined with the first substrate and comprising:

a silicon wafer layer, comprising:

an actuating portion located at a central region of the silicon wafer layer;

an outer peripheral portion disposed around the actuating portion;

a plurality of connecting portions connected between the actuating portion and the outer peripheral portion, respectively; and a plurality of fluid channels placed between the actuating portion and the outer peripheral portion, and located between the connecting portions, respectively;

a second oxidation layer formed on the silicon wafer layer, wherein a vibration chamber is collaboratively defined by the second oxidation layer and the silicon wafer layer; and a silicon material layer disposed on the second oxidation layer and comprising:

a through hole formed at a center of the silicon material layer;

a vibration portion disposed around the through hole; and a fixing portion disposed around the vibration portion;

a piezoelectric component formed and stacked on the actuating portion of the silicon wafer layer, and comprising:

a lower electrode layer;

a piezoelectric layer formed and stacked on the lower electrode layer;

an insulation layer disposed on a partial surface of the piezoelectric layer and a partial surface of the lower electrode layer; and an upper electrode layer formed and stacked on the insulation layer and a remaining surface of the piezoelectric layer without the insulation layer disposed thereon, so as to electrically connect with piezoelectric layer; and a valve layer formed and stacked on the first substrate, wherein a valve unit is fabricated corresponding to the inlet aperture by a photolithographic etching process.

3. The dynamic pressure controlling footwear according to claim 2, wherein the actuating pump has a length ranging from 300 μm to 800 μm, and a width ranging from 300 μm to 800 μm.

4. The dynamic pressure controlling footwear according to claim 2, wherein the actuating pump has a length ranging from 500 μm to 700 μm, and a width ranging from 500 μm to 700 μm.

5. The dynamic pressure controlling footwear according to claim 2, wherein the valve unit comprises a valve conductive layer, a valve base layer and a flexible membrane, wherein the valve conductive layer is formed by an electrically charged piezoelectric material, and is electrically connected to the microprocessor of the control box through the conductor, whereby the microprocessor receives a detection signal from the pressure sensor, calculates the detection signal to obtain a driving signal, and outputs the driving signal to control the valve conductive layer to deform, wherein an accommodation space is maintained between the valve conductive layer and the valve base layer, and the flexible membrane is made of a flexible material, attached to one side of the valve conductive layer and placed in the accommodation space, wherein a plurality of through holes are formed on the valve conductive layer, the valve base layer and the flexible membrane, the through hole of the valve conductive layer and the through hole of the flexible membrane are aligned to each other, and the through hole of the valve base layer and the through hole of the valve conductive layer are misaligned to each other.

6. The dynamic pressure controlling footwear according to claim 5, wherein when the valve conductive layer does not receive the driving signal, the valve conductive layer is maintained in the accommodation space and form a distance from the valve base layer, and the through hole of the valve base layer and the through hole of the valve conductive layer are misaligned to each other, so that the valve unit is opened.

7. The dynamic pressure controlling footwear according to claim 5, wherein when the valve conductive layer receives the driving signal, the valve conductive layer is deformed and attached to the valve base layer, the through hole of the valve base is sealed by the flexible membrane because the through hole of the flexible membrane and the through hole of the valve base are misaligned to each other, so that the valve unit is closed.

* * * * *